US007864025B2

(12) United States Patent
Katsumura et al.

(10) Patent No.: US 7,864,025 B2
(45) Date of Patent: Jan. 4, 2011

(54) COMPONENT WITH COUNTERMEASURE TO STATIC ELECTRICITY

(75) Inventors: Hidenori Katsumura, Hyogo (JP); Tatsuya Inoue, Osaka (JP); Hiroshi Kagata, Osaka (JP)

(73) Assignee: Panasonic Corporation, Osaka (JP)

( * ) Notice: Subject to any disclaimer, the term of this patent is extended or adjusted under 35 U.S.C. 154(b) by 970 days.

(21) Appl. No.: 10/591,255

(22) PCT Filed: Mar. 24, 2005

(86) PCT No.: PCT/JP2005/005322

§ 371 (c)(1),
(2), (4) Date: Aug. 31, 2006

(87) PCT Pub. No.: WO2005/098877

PCT Pub. Date: Oct. 20, 2005

(65) Prior Publication Data

US 2007/0171025 A1 Jul. 26, 2007

(30) Foreign Application Priority Data

Apr. 2, 2004 (JP) ..... 2004-109779

(51) Int. Cl.
*H01C 7/10* (2006.01)

(52) U.S. Cl. ..... 338/21; 257/43

(58) Field of Classification Search ..... 338/21; 257/43

See application file for complete search history.

(56) References Cited

U.S. PATENT DOCUMENTS 3,725,836 A * 4/1973 Wada et al. ..... 338/21
4,186,367 A * 1/1980 Chakrabarty et al. ..... 338/21
5,594,406 A 1/1997 Koyama et al.
6,087,923 A 7/2000 Ahn et al.

FOREIGN PATENT DOCUMENTS

CN 1034370 3/1997
CN 1378218 11/2002

(Continued)

OTHER PUBLICATIONS

Chinese Office Action, with English Translation, issued in Chinese Patent Application No. CN 200580011944.8 dated on Jan. 9, 2009.

(Continued)

*Primary Examiner*—Anh T Mai
*Assistant Examiner*—Joselito Baisa
(74) *Attorney, Agent, or Firm*—McDermott Will & Emery LLP

(57) ABSTRACT

There is provided a static electricity countermeasure component including a varistor layer having a plurality of inner electrodes of a planer shape, embedded therein a board including alumina laminated with the varistor layer, and a terminal connected to the inner electrode of the varistor layer and formed at a side face of the varistor layer, in which the varistor layer and the board are sintered to thereby diffuse bismuth oxide of the varistor layer in the board and provide a bismuth oxide diffusing layer at the board. In this way, the static electricity countermeasure component achieving thin-sized formation while maintaining a varistor characteristic against a small surge voltage can be realized.

13 Claims, 6 Drawing Sheets

FOREIGN PATENT DOCUMENTS

| | | | | |
|---|---|---|---|---|
| JP | 55-077103 | | | 6/1980 |
| JP | 55-77104 | A | | 6/1980 |
| JP | 57-184207 | A | | 11/1982 |
| JP | 58-85502 | A | | 5/1983 |
| JP | 63316405 | A | * | 12/1988 |
| JP | 8-31616 | A | | 2/1996 |
| JP | 11-233309 | A | | 8/1999 |
| JP | 11-251152 | A | | 9/1999 |
| JP | 2001-326108 | A | | 11/2001 |

OTHER PUBLICATIONS

European Search Report issued in European Patent Application No. 05727186.8-1232, mailed Feb. 15, 2010.

* cited by examiner

COMPONENT WITH COUNTERMEASURE TO STATIC ELECTRICITY

RELATED APPLICATIONS

This application is the U.S. National Phase under 35 U.S.C. §371 of International Application No. PCT/JP2005/005322, filed on Mar. 24, 2005, which in turn claims the benefit of Japanese Application No. 2004-109779, filed on Apr. 2, 2004, the disclosures of which Applications are incorporated by reference herein.

TECHNICAL FIELD

The present invention relates to a static electricity countermeasure component used in various electronic apparatus.

BACKGROUND ART

In recent years, small-sized formation and high function formation of an electronic apparatus such as a portable telephone are progressed rapidly, and in accordance therewith, the circuit of such electronic apparatus is constituted in a high density and withstand voltage thereof is reduced. Therefore, destruction of an electric circuit provided inside of an apparatus by an electrostatic pulse generated when the human body and a terminal of the electronic apparatus are brought into contact with each other is increased. As a countermeasure against such an electrostatic pulse, there is carried out a method of restraining a voltage applied to the electric circuit of the electronic apparatus bypassing static electricity by providing a multilayer chip varistor between a line through which static electricity is inputted and the ground. An example of a multilayer chip varistor used in a countermeasure against the electrostatic pulse is disclosed in Japanese Patent Unexamined Publication No. H08-31616.

A static electricity countermeasure component (hereinafter, referred to as component) of a background art will be explained in reference to FIG. 9 as follows. FIG. 9 is a sectional view of a multilayer chip varistor (hereinafter, referred to as MLCV). MLCV includes varistor layer 2 having inner electrode 1 and terminal 3 connected to inner electrode 1 at an end face of varistor layer 2. Protecting layers 4 are provided at upper and lower faces of varistor layer 2.

According to MLCV of the background art, crack or chipping is liable to be brought about unless a thickness to some degree is ensured in order to satisfy a physical strength of varistor layer 2. As a result, a problem that thin-sized formation of MLCV is difficult is posed. For example, in a case of MLCV having a length of about 1.25 mm, a width of about 2.0 mm, a thickness equal to or larger than about 0.5 mm is needed. When the thickness is thinned further, the length and the width need to be reduced. Therefore, it is difficult to achieve thin-sized formation while maintaining a varistor characteristic against a small surge voltage.

SUMMARY OF THE INVENTION

A multilayer chip varistor of the invention includes a varistor layer, and a board laminated with the varistor layer, the varistor layer is formed by a material including at least bismuth oxide, and the varistor layer and the board are sintered to thereby diffuse bismuth oxide to the board and provide a bismuth oxide diffusing layer on the board. Thereby, the varistor layer is laminated on the board and therefore, even when a mechanical strength of the varistor layer is small, since a mechanical strength of the board is added, thin-sized formation can be achieved.

Particularly, by simply laminating the varistor layer on the board, exfoliation of the varistor layer and the board is liable to be brought about. According to the multilayer chip varistor of the invention, the varistor layer is formed by the material at least including bismuth oxide, and bismuth oxide is diffused to the board by sintering the varistor layer and the board. On the other hand, since the board is provided with the bismuth oxide diffusing layer, the varistor layer and the board constitute an integral substance and exfoliation at an interface portion of the varistor layer and the board can be prevented. As a result, the static electricity countermeasure component achieving thin-sized formation while maintaining a varistor characteristic against a small surge voltage can be provided.

REFERENCE MARKS IN THE DRAWINGS

Figure 1:
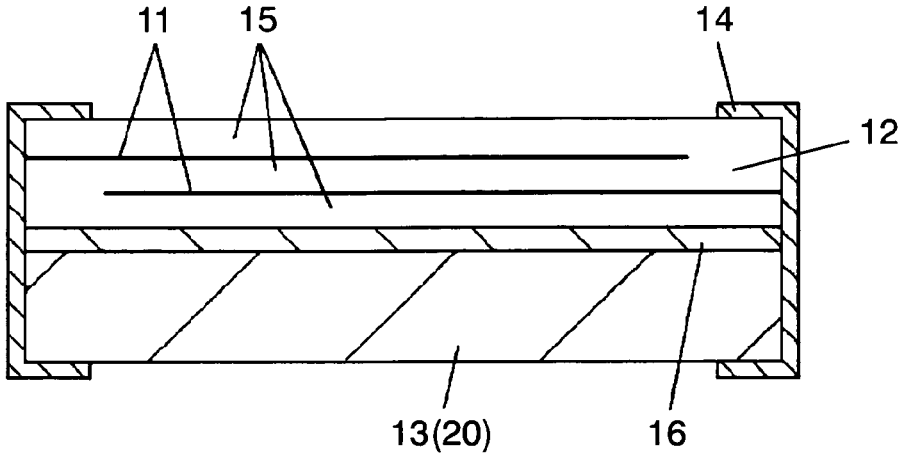
FIG. 1 is a sectional view of a static electricity countermeasure component (component) according to an embodiment of the invention.

11 inner electrode
12 varistor layer
13 board
14 terminal
15 green sheet
16 bismuth oxide diffusing layer
17 bismuth oxide particle
18 adhesive layer
19 glass ceramic layer
20 alumina board
21 glass diffusing layer

DETAILED DESCRIPTION OF PREFERRED EMBODIMENT

An embodiment as an example of the invention will be explained in reference to the drawings. Further, the drawings are schematic views and do not show respective positional relationships dimensionally correctly. Further, the invention is not limited to the embodiment.

Embodiment

Figure 2:
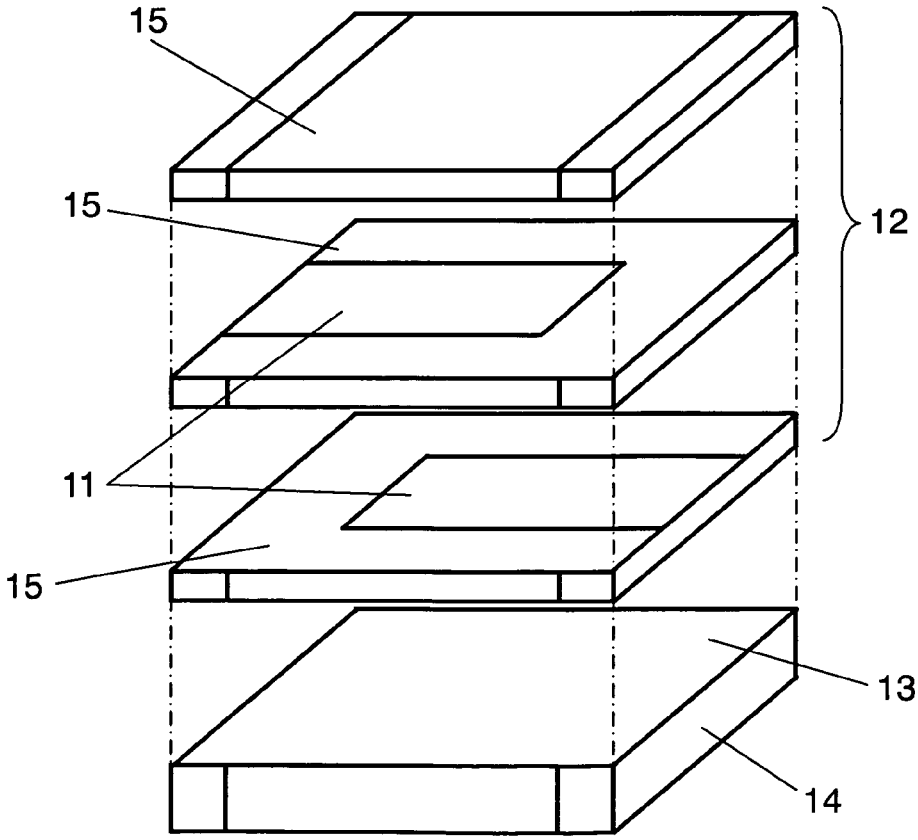
FIG. 2 is a exploded perspective view of the component shown in FIG. 1.
Figure 3:
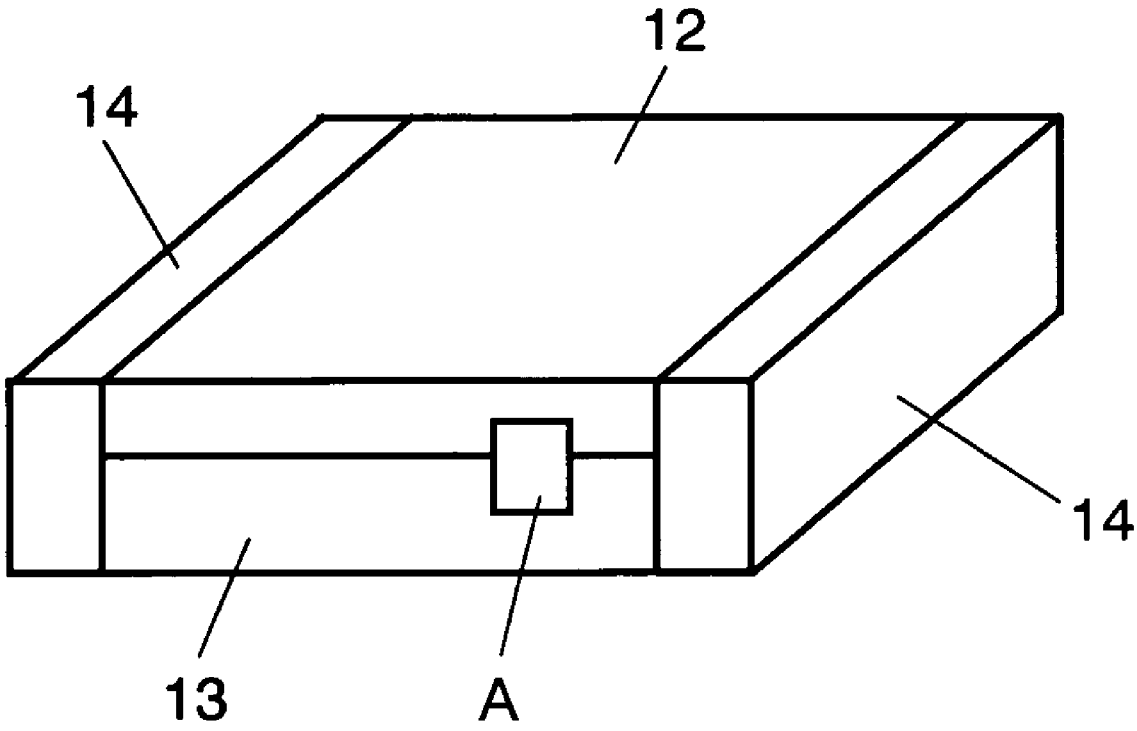
FIG. 3 is a perspective view of the component shown in FIG. 1.

In FIG. 1-FIG. 3, a component according to the embodiment includes varistor layer 12 having a plurality of inner electrodes 11 of a planer shape embedded therein, board 13 including alumina laminated with varistor layer 12, terminal 14 connected to inner electrode 11 of varistor layer 12 and formed at a side face of varistor layer 12.

Figure 4:
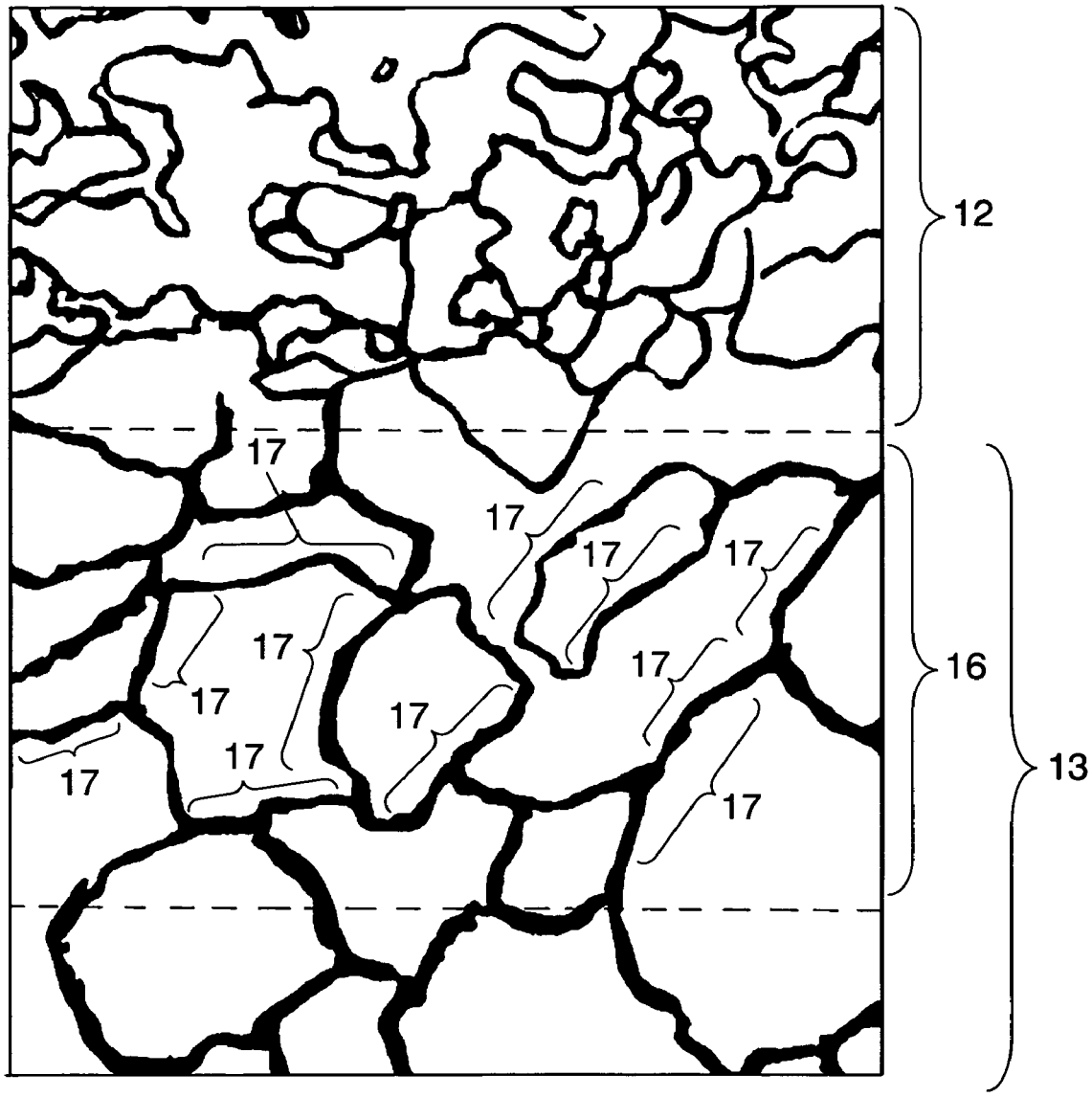
FIG. 4 is an enlarged schematic view of a board showing a state of bismuth oxide diffused in the board.

Varistor layer 12 is formed by laminating and sintering a plurality of unsintered green sheets 15 which include a powder of a varistor material constituted of zinc oxide as a major component and at least bismuth oxide as an additive. Particularly, a mean particle diameter of the powder of the varistor material is constituted to be 0.5-2.0 μm and a mean particle diameter of a powder of bismuth oxide is constituted to be equal to or smaller than 1.0 μm. When green sheets 15 are laminated by being coated with an electrically conductive paste including silver or the like in a planer shape, inner electrode 11 can be embedded in varistor layer 12. Further, by sintering varistor layer 12 and board 13 to diffuse bismuth oxide of varistor layer 12 in board 13, bismuth oxide diffusing layer 16 is formed at board 13. Sintering of unsintered green sheets 15 including the powder of the varistor material to form varistor layer 12 and sintering of varistor layer 12 and board 13 are carried out simultaneously. At this occasion, as shown by FIG. 4, bismuth oxide is diffused in board 13 such that bismuth oxide particle 17 is interposed at an interface of alumina particles included in board 13. When board 13 is constituted by a low temperature sintered ceramic board (which is formed by sintering unsintered ceramic sheet capable of being sintered at low temperatures), varistor layer 12 and board 13 can be sintered by laminating unsintered green sheet 15 including the powder of the varistor material onto the unsintered ceramic sheet capable of being sintered at low temperatures and simultaneously sintering these at a sintering temperature lower than a general temperature. In this way, even by using a material such as silver or the like as inner electrode 11, an adverse influence owing to heat is not seen on inner electrode 11.

Figure 5:
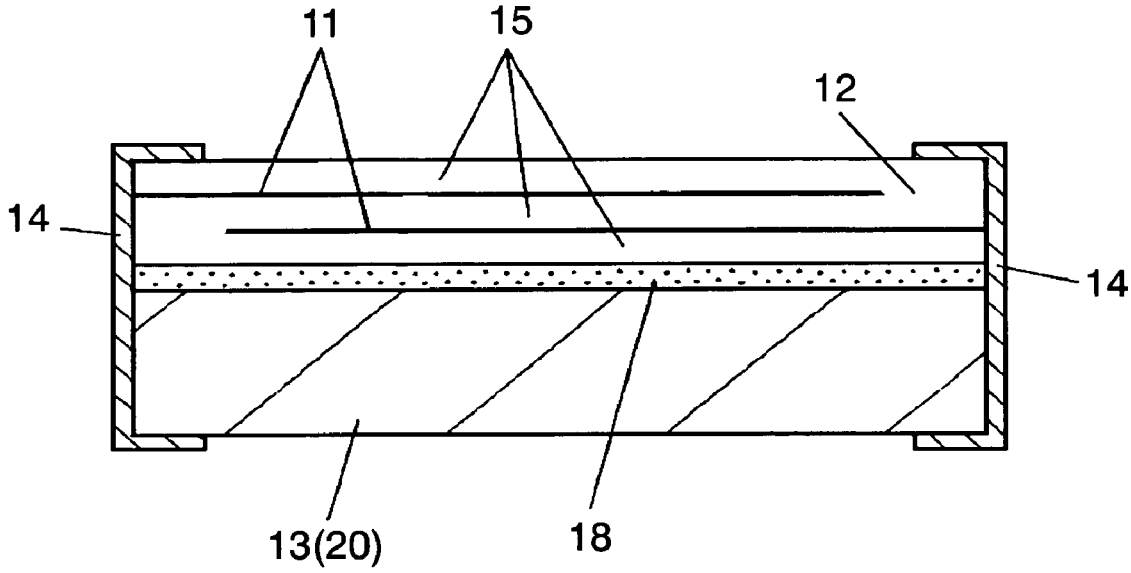
FIG. 5 is a sectional view of the component shown in FIG. 1 before sintering a varistor layer and the board.

Further, as shown by FIG. 5, adhesive layer 18 is provided between varistor layer 12 and board 13 before sintering varistor layer 12 and board 13. In sintering varistor layer 12 and board 13, bismuth oxide is diffused in board 13 by way of adhesive layer 18. After sintered, adhesive layer 18 becomes any of the following three. First, adhesive layer 18 is completely vanished, second, a portion of a component thereof remains as adhesive layer 18, and third, a portion of the component is diffused in varistor layer 12 or board 13.

Figure 6A:
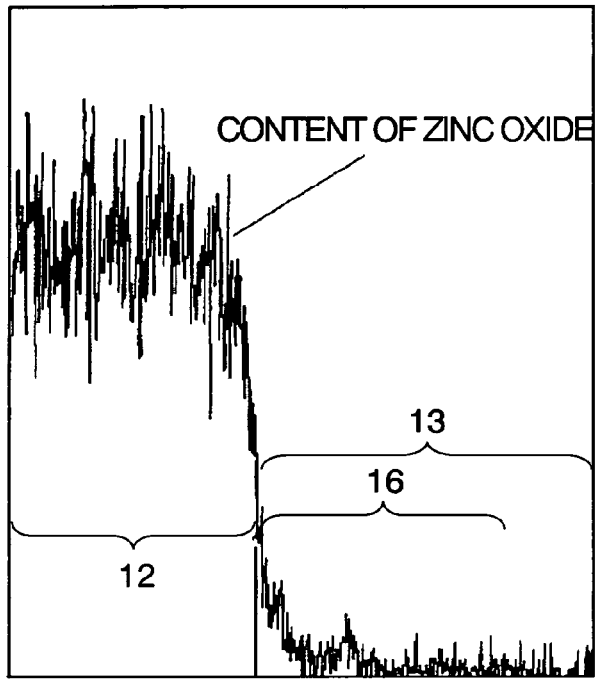
FIG. 6A is an analysis graph showing a constituent composition of the component shown in FIG. 1
Figure 6B:
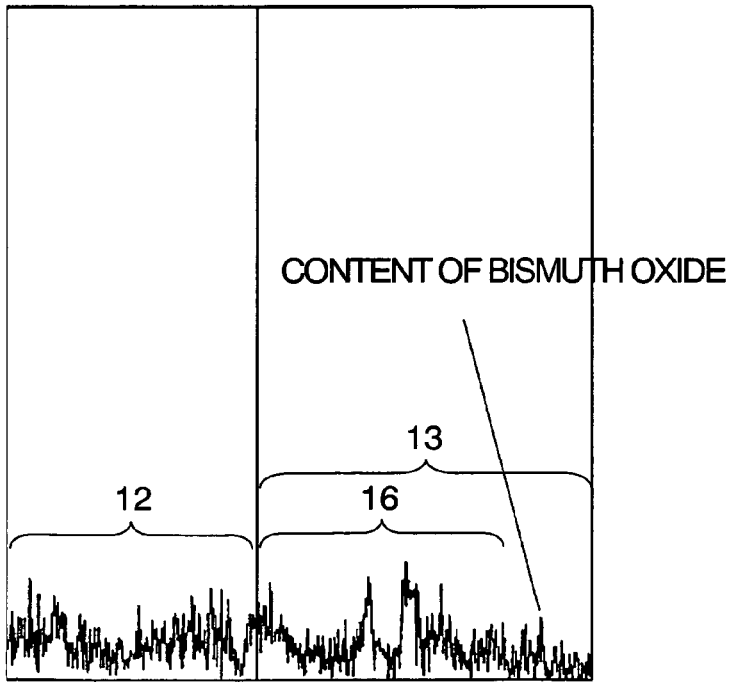
FIG. 6B is an analysis graph showing a constituent composition of the component shown in FIG. 1.

FIG. 6A and FIG. 6B show a result of analysis by XMA with regard to a constituent composition at a vicinity of the interface of varistor layer 12 and board 13. The abscissa designates a wavelength (that is, corresponding to energy), the ordinate designates an intensity, respectively. A kind of an element is known from the wavelength, and a content of an element is known from the intensity. As shown by the diagrams, varistor layer 12 includes zinc oxide which is the major component and bismuth oxide which is the additive, and bismuth oxide is diffused in board 13 to form bismuth oxide diffusing layer 16 at a portion having a large content thereof. Here, the main component signifies zinc oxide equal to or larger than 80 wt % and the additive signifies less than 20 wt %, the both constituting a composition of 100% in combination. Further, it is preferable that an amount of bismuth oxide in the additive falls in a range of 50 wt % through 80 wt %. As an example of an additive other than bismuth oxide, cobalt oxide, antimony oxide, glass or the like is pointed out. Further, as a glass, borosilicate glass or the like is used.

By the above-described constitution, varistor layer 12 is laminated on board 13 and therefore, even when a mechanical strength of varistor layer 12 is small, a mechanical strength of board 13 is added and therefore, thin-sized formation can be achieved. Particularly, board 13 is constituted by alumina board 20 including alumina and therefore, alumina board 20 has stronger mechanical strength than varistor layer 12. As a result, even when varistor layer 12 is made to be very thin and also board 13 per se is made to be very thin, crack or chipping can be restrained from being brought about at varistor layer 12 and thin-sized formation can further be achieved.

By only laminating varistor layer 12 on board 13, varistor layer 12 and board 13 are liable to be exfoliated from each other. According to the embodiment, varistor layer 12 is formed by the material including at least bismuth oxide, oxide bismuth is diffused in board 13 by sintering varistor layer 12 and board 13, and bismuth oxide diffusing layer 16 is provided at board 13. In this way, varistor layer 12 and board 13 become an integral substance, and therefore, exfoliation at an interface portion of varistor layer 12 and board 13 can be prevented.

Particularly, adhesive layer 18 is provided between varistor layer 12 and board 13, and bismuth oxide is diffused in board 13 by way of adhesive layer 18. As a result, when bismuth oxide is diffused from varistor layer 12 to board 13, bismuth oxide is diffused in a state that exfoliation of varistor layer 12 and board 13 is restrained and therefore, bismuth oxide is easy to be diffused and exfoliation of varistor layer 12 and board 13 can be restrained by precisely forming bismuth oxide layer 16 at board 13.

It is preferable that the mean particle diameter of the powder of the varistor material falls in a range of 0.5 μm through 2.0 μm. When the mean particle diameter is less than 0.5 μm, there occurs a problem that unsintered green sheet 15 including the powder of the varistor material cannot be formed while when the mean particle diameter conversely exceeds 2.0 μm, there occurs a problem that green sheet 15 cannot be sintered. It is particularly preferable to constitute the mean particle diameter of the powder of bismuth oxide to be equal to or smaller than 1.0 μm. In this way, the varistor material is made to be easy to be diffused to board 13 and exfoliation of varistor layer 12 and board 13 can further be prevented.

Figure 7:
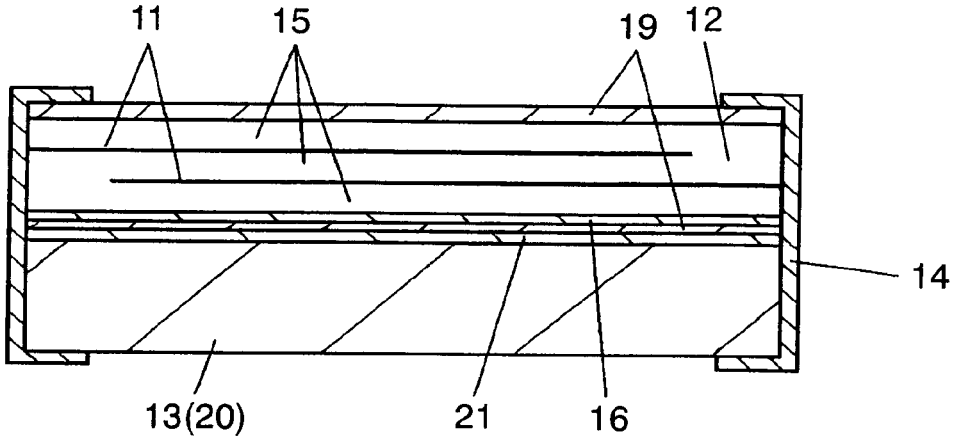
FIG. 7 is a sectional view of a component according to other embodiment.

As shown by FIG. 7, glass ceramic layer 19 including glass is laminated onto alumina board 20 as board 13. Bismuth oxide diffusing layer 16 is formed at glass ceramic layer 19 by diffusing bismuth oxide of varistor layer 12 in glass ceramic layer 19. Glass diffusing layer 21 may be formed at alumina board 20 by diffusing glass of glass ceramic layer 19 in alumina board 20. Thereby, varistor layer 12, glass ceramic layer 19 and alumina board 20 are made to be difficult to be exfoliated from each other. Particularly, since varistor layer 12 is brought into contact with glass ceramic layer 19, in comparison with the case that alumina board 20 and varistor layer 12 are brought into contact with each other, an influence of alumina board 20 on varistor layer 12 is small so that a deterioration in the varistor characteristic can be restrained.

Figure 8:
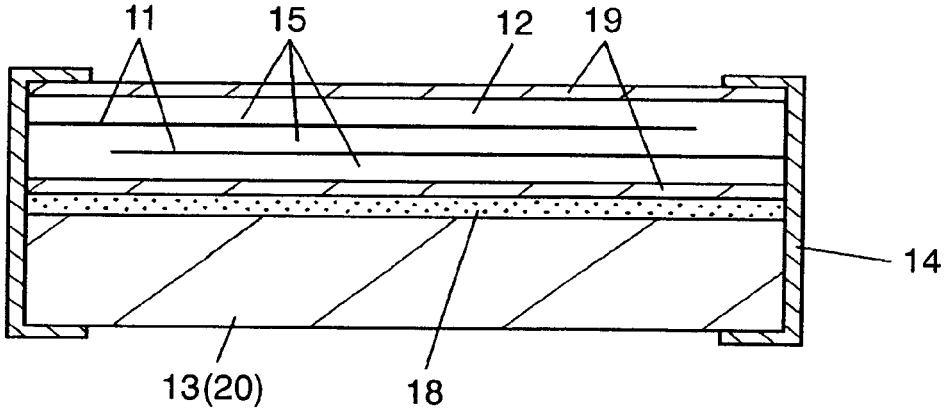
FIG. 8 is a sectional view of the component shown in FIG. 7 before sintering a varistor layer and a board.
Figure 9:
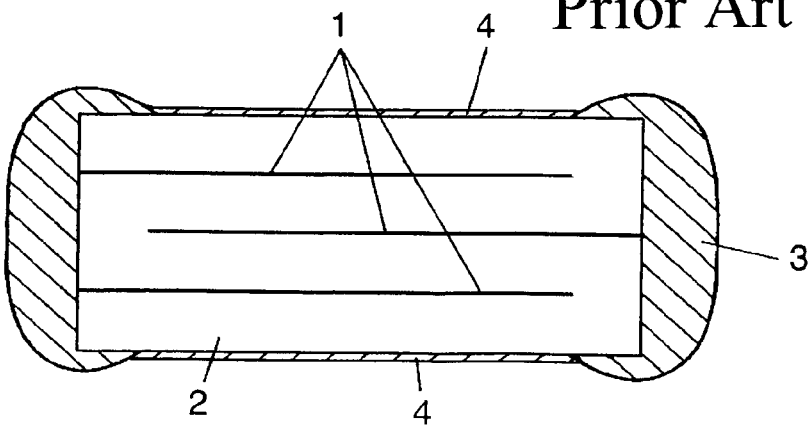
FIG. 9 Prior Art
FIG. 9 is a sectional view of MLCV which is a component of the background art.

As shown by FIG. 8, adhesive layer 18 may be provided between glass ceramic layer 19 and alumina board 20 and glass may be diffused in alumina board 20 by way of adhesive layer 18. In this case, in sintering varistor layer 12 and board 13, glass is diffused in alumina board 20 by way of adhesive layer 18. After sintering is finished, adhesive layer 18 becomes any one of the following three. First, adhesive layer 18 is completely vanished, second, a portion of a component thereof remains as adhesive layer 18, and third, a portion of a component thereof is diffused in varistor layer 12 or alumina board 20. Thereby, when glass is diffused from glass ceramic layer 19 to alumina board 20, glass is diffused in a state that exfoliation of glass ceramic layer 19 and alumina board 20 is restrained. In this way, glass is made to be easy to diffuse and glass diffusing layer 21 is formed precisely at alumina board 20 and therefore, exfoliation of glass ceramic layer 19 and alumina board 20 can be prevented. Glass ceramic layer 19 including glass may be laminated on an upper face of varistor layer 12. Thereby, bismuth oxide of varistor layer 12 is restrained from being diffused from a surface of varistor layer 12 into air, bismuth oxide is made to be easy to be diffused in board 13 and therefore, exfoliation of varistor layer 12 and board 13 is made to be easy to be prevented.

Such a component may be formed with an electronic circuit including other resistor, coil, capacitor or the like. For example, a circuit board formed with an electronic component circuit may be used as the board of the invention, or a circuit layer formed with an electronic component circuit may be laminated on a face of board 13 opposed to a side on which laminating varistor layer 12 is laminated. When an electronic component circuit is formed by a thin film formation or the like, thin-sized formation can be achieved. In this way, a static electricity countermeasure component of a thin size can be realized by applying the invention to various electronic apparatus or the like.

INDUSTRIAL APPLICABILITY

As described above, the component of the invention can achieve a thin-sized formation while maintaining the varistor characteristic against a small surge voltage and therefore, the component is applicable to various electronic apparatus or the like.

The invention claimed is:

1. A static electricity countermeasure component comprising:

a varistor layer;

a board laminated with the varistor layer; and a bismuth oxide diffusing layer provided at the board;

wherein the varistor layer comprises a material including at least bismuth oxide, and the bismuth oxide diffusing layer is provided between the varistor layer and the board.

2. The static electricity countermeasure component of claim 1, wherein the board is an alumina board.

3. The static electricity countermeasure component of claim 2, wherein the board is formed by laminating a glass ceramic layer including glass on the alumina board.

4. The static electricity countermeasure component of claim 3, wherein the glass is diffused in the alumina board, and a glass diffusing layer is provided at the alumina board.

5. The static electricity countermeasure component of claim 3, wherein an adhesive layer is provided between the glass ceramic layer and the alumina board, the glass is diffused in the alumina board by way of the adhesive layer, and a glass diffusing layer is provided at the alumina board.

6. The static electricity countermeasure component of claim 1, wherein a glass ceramic layer including glass is laminated on the varistor layer.

7. The static electricity countermeasure component of claim 1, wherein the varistor layer is formed by laminating and sintering a plurality of unsintered green sheets including a powder of a varistor material, and a mean particle diameter of the powder of the varistor material falls in a range of 0.5-2.0 μm.

8. The static electricity countermeasure component of claim 7, wherein the varistor material comprises zinc oxide as a major component and at least bismuth oxide as an additive, and a mean particle diameter of a powder of the bismuth oxide is equal to or smaller than 1.0 μm.

9. The static electricity countermeasure component of claim 1, wherein an adhesive layer is provided between the varistor layer and the board, and the bismuth oxide is made to be diffused in the board by way of the adhesive layer.

10. The static electricity countermeasure component of claim 1, wherein the board is constituted by a circuit board having an electronic component circuit formed therein.

11. The static electricity countermeasure component of claim 1, wherein the board is laminated with a circuit layer on which an electronic component circuit is formed, on a side opposed to a side on which the varistor layer is laminated.

12. The static electricity countermeasure component of claim 1, wherein the board is constituted by a low temperature sintering ceramic board.

13. The static electricity countermeasure component of claim 1, wherein the bismuth oxide diffusing layer is made of bismuth oxide and the material of the board.

* * * * *